US009683731B2

(12) United States Patent
Kim et al.

(10) Patent No.: US 9,683,731 B2
(45) Date of Patent: Jun. 20, 2017

(54) HOME APPLIANCE HAVING DISPLAY UNIT

(71) Applicant: SAMSUNG ELECTRONICS CO., LTD., Suwon-si, Gyeonggi-do (KR)

(72) Inventors: Sung Jin Kim, Gyeonggi-do (KR); Jae Man Joo, Gyeonggi-do (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 81 days.

(21) Appl. No.: 14/590,126

(22) Filed: Jan. 6, 2015

(65) Prior Publication Data

US 2015/0192288 A1 Jul. 9, 2015

(30) Foreign Application Priority Data

Jan. 6, 2014 (KR) ..... 10-2014-0001530

(51) Int. Cl.
*A47L 15/00* (2006.01)
*F21V 33/00* (2006.01)
(Continued)

(52) U.S. Cl.
CPC ..... *F21V 33/0044* (2013.01); *A47L 15/4261* (2013.01); *A47L 15/4274* (2013.01); *A47L 15/4293* (2013.01); *D06F 39/005* (2013.01); *D06F 39/14* (2013.01); *F21V 31/00* (2013.01); *F24C 7/082* (2013.01); *F21W 2131/30* (2013.01); *F21Y 2115/10* (2016.08)

(58) Field of Classification Search
CPC ..... A47L 15/4261; A47L 15/4274; A47L 15/4293; D06F 39/005; D06F 39/04; F21V 31/005; F21V 39/14; F21V 31/00; F21V 33/0044; F21W 2131/30; F21Y 2102/02; F21Y 2101/00; F21L 7/082; F24C 7/082
See application file for complete search history.

(56) References Cited

U.S. PATENT DOCUMENTS 5,453,586 A * 9/1995 Stottmann ..... H01H 13/70 200/302.2
7,695,572 B2 * 4/2010 Ahn ..... A47L 15/0002 134/102.1
(Continued)

OTHER PUBLICATIONS

European Office Action dated Jul. 12, 2016 in corresponding European Patent Application No. 15 150 214.3.

*Primary Examiner* — Peggy Neils
(74) *Attorney, Agent, or Firm* — Staas & Halsey LLP

(57) ABSTRACT

Disclosed herein is a home appliance having a front surface panel provided with penetrating holes formed thereto as to have light penetrated therethrough, a door having a rear surface panel, and a display unit provided inside the door and configured to display operation information through the penetrating holes of the front surface panel. The display unit includes a printed circuit board provided with at least one light emitting element, a guide member configured to guide light radiated from the at least one light emitting element, a display film having penetration portions corresponding with the penetrating holes of the front surface panel, and attached to the guide member, and a cover member provided at the guide member so as to prevent moisture from penetrating at the printed circuit board, and thus the exterior appearance of the door may be improved.

12 Claims, 9 Drawing Sheets

(51) Int. Cl.

| | |
|---|---|
| ***A47L 15/42*** | (2006.01) |
| ***D06F 39/00*** | (2006.01) |
| ***D06F 39/14*** | (2006.01) |
| ***F21V 31/00*** | (2006.01) |
| ***F24C 7/08*** | (2006.01) |
| *F21W 131/30* | (2006.01) |
| *F21Y 115/10* | (2016.01) |

(56) References Cited

U.S. PATENT DOCUMENTS

| | | | | |
|---|---|---|---|---|
| 8,262,807 | B2 * | 9/2012 | Son | A47L 15/4257 134/56 D |
| 8,460,479 | B2 * | 6/2013 | Haeberle | A47L 15/4257 134/56 D |
| 8,857,034 | B2 * | 10/2014 | Schaefer | A47L 15/4246 29/469 |
| 2011/0134627 | A1 * | 6/2011 | Hamlin | F21V 33/0044 362/92 |
| 2011/0181516 | A1 * | 7/2011 | Mallory | A47L 15/4293 345/173 |
| 2015/0049455 | A1 * | 2/2015 | Heater | A47L 15/4293 362/23.13 |

* cited by examiner

HOME APPLIANCE HAVING DISPLAY UNIT

CROSS-REFERENCE TO RELATED APPLICATIONS

This application claims the benefit of the Korean Patent Application No. 10-2014-0001530, filed on Jan. 6, 2014, in the Korean Intellectual Property Office, the disclosure of which is incorporated herein by reference.

BACKGROUND

1. Field

Embodiments of the present disclosure relate to a home appliance having a hidden display.

2. Description of the Related Art

In general, a home appliance such as a dishwashing machine, an oven, or a washing machine is provided with a body, a tub provided at an inside of the body having a front surface thereof open, a door rotatably coupled to the body as to open/close the open front surface of the tub, and a display configured to display operation information of the home appliance.

Among the home appliances such as the dishwashing machine, the oven, and the washing machine, a certain one of the home appliances may be provided with a structure having a display hiddenly provided at an inside of the door and configured such that the light radiated from the display is displayed at an outside through a front surface panel.

A penetration window formed with resin or glass as to have the light radiated from the display penetrated therethrough is formed at the front surface panel of the door of the home appliance having a conventional structure of the hidden display.

At this time, in a case when a remaining portion of the front surface panel other than the penetration window is formed in steel plate material, the penetration window and the remaining portion of the front surface panel are formed in different material with respect to each other, and thus sense of difference may be present while aesthetic sense is reduced.

SUMMARY

Therefore, it is an aspect of the present disclosure to provide a home appliance formed of the same material of steel plate having a front surface panel provided without a separate penetration window, and provided with a door having improved aesthetic sense while a display unit is hidden at an inside of the door.

Additional aspects of the disclosure will be set forth in part in the description which follows and, in part, will be obvious from the description, or may be learned by practice of the disclosure.

In accordance with one aspect of the present disclosure, a home appliance includes a body, a tub provided inside the body and having a front surface thereof open, a door rotatably provided as to open/close the tub and having a front surface panel and a rear surface panel where the front surface panel having penetrating holes so as to have light penetrated therethrough. A display unit is provided inside the door and configured to display operation information through the penetrating holes of the front surface panel, and the display unit may include a printed circuit board provided with at least one light emitting element, a guide member configured to guide the light radiated from the at least one light emitting element, a display film having penetration portions corresponding with the penetrating holes of the front surface panel, and attached to the guide member; and a cover member provided at the guide member so as to prevent moisture from penetrating at the printed circuit board.

The front surface panel and the rear surface panel may be formed of steel plate material.

The cover member may include epoxy resin.

The home appliance may further include an adhesive member configured to couple the display unit into a rear surface of the front surface panel.

The adhesive member may be provided at an outer periphery of the display film.

The adhesive member and the display film may be provided to have identical heights.

The guide member may include supporting walls protruded so as to support the printed circuit board and the cover member.

The display unit may further include a connector provided so as to penetrate the cover member such that a power may be supplied to the printed circuit board.

A diameter of the penetrating holes may be from about 0.3 mm to about 0.5 mm.

The gap between the penetrating holes may be from about 0.5 mm to about 1.5 mm.

The display unit may further include a filler member filled at the penetrating holes so as to prevent foreign substance from penetrating into the penetrating holes.

The filler member may be formed of transparent material or semi-transparent material.

In accordance with another aspect of the present disclosure, a home appliance includes a body, a tub provided inside the body and having a front surface thereof open, a door configured to open/close the front surface of the tub, and a hinge member configured to rotatably couple the door into the body. The door includes a front surface panel configured to form an exterior appearance of a front of the door, formed of steel plate material with penetrating holes such that light may penetrate therethrough, a rear surface panel coupled to the front surface panel so as to form a rear exterior appearance of the door, a handle provided at the front surface panel so as to enable the door to open and close, a display unit coupled to a rear surface of the front surface panel at a position corresponding with the penetrating holes of the front surface panel so as to display operation information through the penetrating holes of the front surface panel, and an adhesive member provided at a front surface edge of the display unit so as to attach the display unit at a rear surface of the front surface panel.

The rear surface panel may be formed of steel plate material.

The display unit may include a printed circuit board provided with at least one light emitting element installed thereto, a guide member configured to guide the light radiated from the at least one light emitting element, a display film having penetration portions corresponding with the penetrating holes of the front surface panel, and attached to the guide member, and a cover member provided at the guide member so as to prevent moisture from penetrating at the printed circuit board.

The display unit may further include a connector provided so as to penetrate the cover member such that a power may be supplied to the printed circuit board.

The guide member may include supporting walls protruded so as to support the printed circuit board and the cover member.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
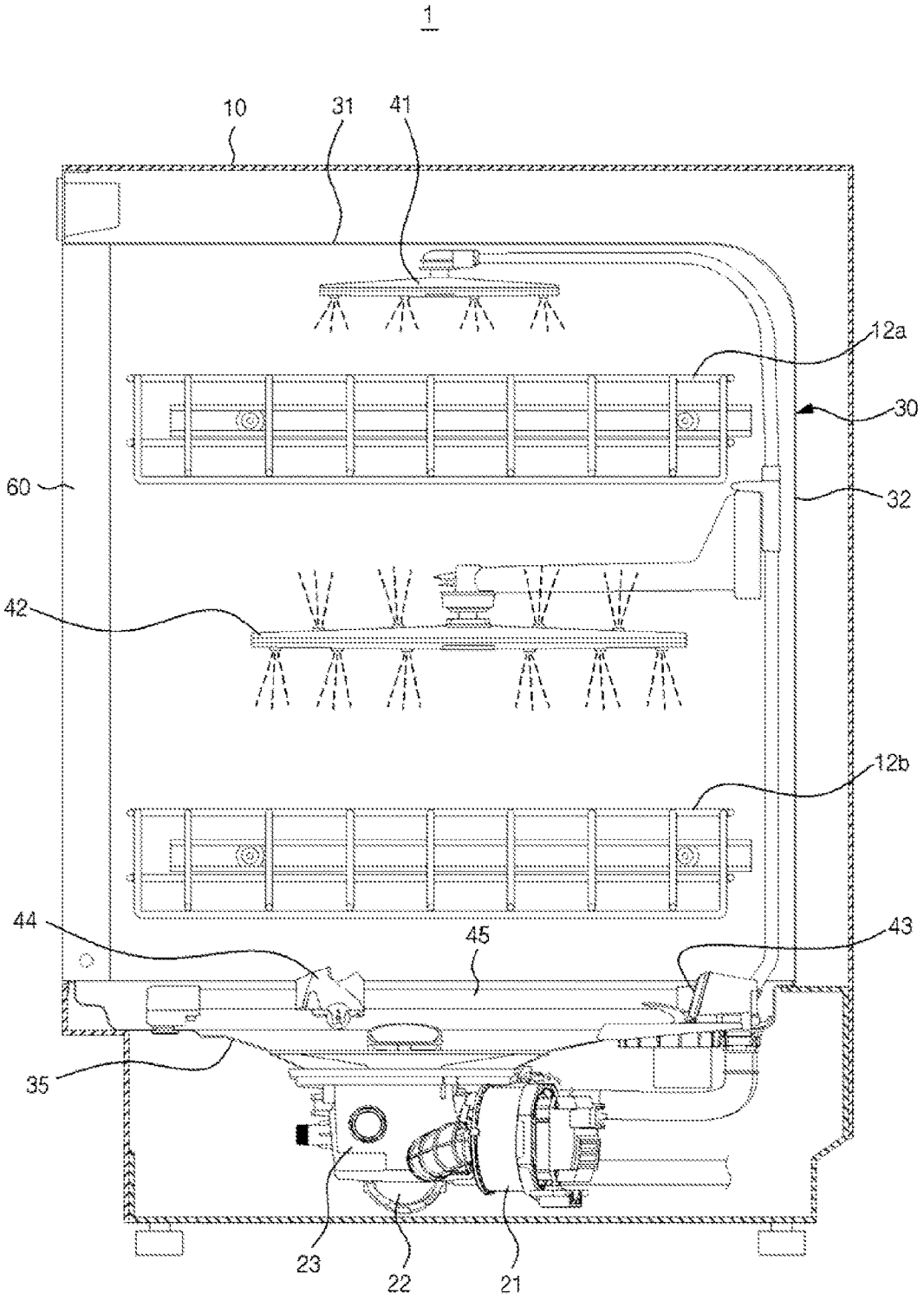
FIG. 1 is a schematic cross-sectional view illustrating a home appliance in accordance with one embodiment of the present disclosure.

Reference will now be made in detail to the embodiments of the present disclosure, examples of which are illustrated in the accompanying drawings, wherein like reference numerals refer to like elements throughout.

Figure 2:
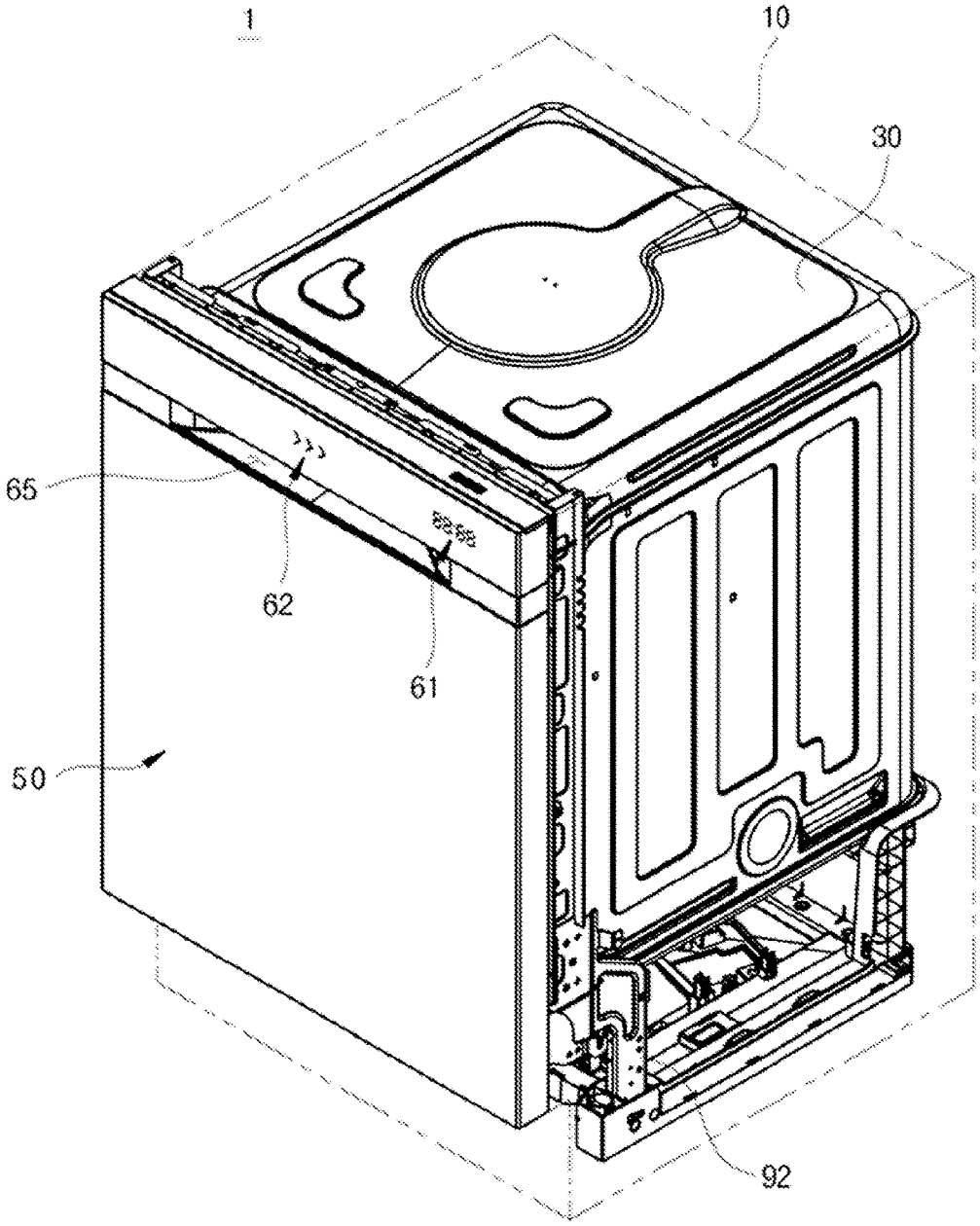
FIG. 2 is a perspective view illustrating the home appliance of FIG. 1.

FIG. 1 is a schematic cross-sectional view illustrating a home appliance in accordance with one embodiment of the present disclosure, and FIG. 2 is a perspective view illustrating the home appliance of FIG. 1.

Hereinafter, an aspect of the present disclosure will be described by using a dishwashing machine as one embodiment of the present disclosure. However, the aspect of the present disclosure is not limited hereto, and may be applied to other home appliances such as an oven and a washing machine.

A dishwashing machine 1 includes a body 10 forming an exterior appearance, a tub 30 provided at an inside of the body 10, baskets 12*a* and 12*b* provided at an inside of the tub 30 as to store items, for example, tableware, spraying nozzles 41, 42, and 43 to spray washing water, a sump 23 to store the washing water, a circulation pump 21 to pump the washing water at the sump 23 to supply such to the spraying nozzles 41, 42, and 43, a draining pump 22 to discharge the washing water of the sump 23 along with garbage to an outside the body 10, a vane 44 to reflect the washing water toward a side of the tableware while moving at an inside of the tub 30, and a rail 45 to guide movements of the vane 44.

The tub 30 includes a washing tub to wash tableware. The tub 30 may be provided with the approximate shape of a box having a front thereof open as to deposit/withdraw the tableware. Thus, the tub 30 may be provided with an upper side wall 31, a rear side wall 32, a left side wall and a right side wall (not shown), and a bottom panel 35. The open front of the tub 30 may be opened/closed by use of a door 50. The door 50 may be rotatably coupled to the body 10 in vertical direction by use of hinge members 91 and 92 (FIG. 3) provided at both sides of a lower portion of the door 50.

The baskets 12*a* and 12*b* may be provided with a wire rack formed with wires such that remaining washing water may be penetrated. The baskets 12*a* and 12*b* may be detachably provided at an inside of the tub 30. The baskets 12*a* and 12*b* may include an upper basket 12*a* disposed at an upper portion of the tub 30 and a lower basket 12*b* disposed at a lower portion of the tub 30.

Display units 100 and 200 (FIG. 3) to display operation information of the home appliance may be disposed at an inside of the door 50. In addition, a handle 65 to open/close the door 50 by gripping the handle 62, as well as penetrating holes 61 and 62 provided such that a user may be able to see the information displayed at the display units 100 and 200 as the light radiated from the display units 100 and 200 are penetrated through the penetrating holes 61 and 62, may be formed. The details of the structure of the door 50 as such will be described hereinafter.

Figure 3:
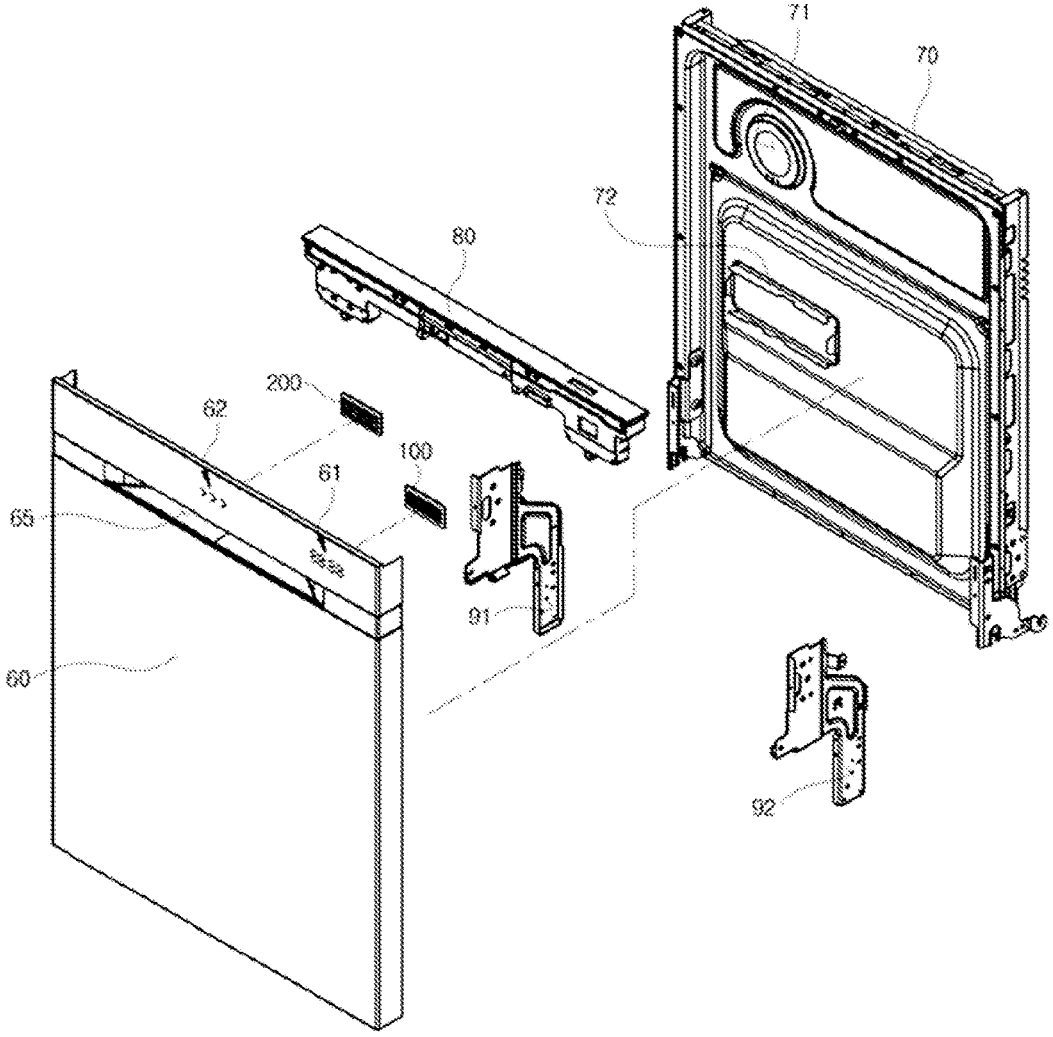
FIG. 3 is an exploded view illustrating a door of the home appliance of FIG. 1.

FIG. 3 is an exploded view illustrating a door of the home appliance of FIG. 1.

Referring to FIG. 3, the door 50 (FIG. 2) may include a front surface panel 60 forming a front exterior appearance of the door 50, a rear surface panel 70 coupled to a rear of the front surface panel 60 and forming a rear exterior appearance of the door 50, and an upper cap 80 coupled to upper portions of the front surface panel 60 and the rear surface panel 70. A lower portion of the door 50 may be open as to have air flow at an inside of the door 50.

The front surface panel 60 may be formed of steel plate material as to improve aesthetic sense and durability. Furthermore, the front surface panel 60 of the dishwashing machine 1 in accordance with an embodiment of the present disclosure may be formed with single material of steel plate without requiring a penetration window to be formed of glass or resin material as to have the light radiated from the display units 100 and 200 penetrated through the penetration window, and thus aesthetic sense may be improved.

In place of the penetration window, the penetrating holes 61 and 62 are formed at the front surface panel 60 such that the light radiated from the display units 100 and 200 may penetrate the penetrating holes 61 and 62 as to have a user recognize the information displayed by the display units 100 and 200. The details with respect to the penetrating holes 61 and 62 will be described later.

The front surface panel 60 may be provided with an improved aesthetic sense through a surface treatment, which is a unique characteristic of metallic material. That is, hair line processing, a mirror processing, or bead blast processing may be performed on the surface of the front surface panel 60.

A handle 65 configured to be gripped as to open/close the door 50 may be provided at the front surface panel 60. The front surface panel 60 as such may be formed through a press processing or other steel plate processing methods.

Although not illustrated, a control panel (not shown) configured to control functions of the dishwashing machine 1 may be provided at a front surface of the front surface panel 60 or at an upper surface of the upper cap 80.

The rear surface panel 70 may be formed of steel plate material as in the front surface panel 60 as to prevent corrosion by washing water of the tub 30. The rear surface panel 70 may perform functions to support the baskets 12*a* and 12*b* withdrawn from the tub 30 when the door 50 is open, and to collect washing water so that the washing water stored at the baskets 12*a* and 12*b* may not fall to the bottom surface.

A detergent container accommodation unit 72 in which the detergent container (not shown) is accommodated may be formed at the rear surface panel 70. A duct connection part (71) to which a duct (not shown) configured to discharge the heat of the tub 30 to an outside at the time of drying the tub 30 is connected may be provided at the rear surface panel 70.

The rear surface panel 70 as such may be formed through a press processing or other steel plate processing methods.

The upper cap 80 is coupled to upper portions of the front surface panel 60 and the rear surface panel 70, and is provided to form an upper surface of the door 50. The upper cap 80 may be formed of resin material.

The display units 100 and 200 configured to display operation information of the dishwashing machine 1 may be disposed in between the front surface panel 60 and the rear surface panel 70. In detail, the display units 100 and 200 may be closely attached to a rear surface of the front surface panel 60.

The front surface panel 60 as such, the dispositions of the display units 100 and 200, and detailed structures of the display units 100 and 200 will be described in detail hereinafter.

The display units 100 and 200 may include a display unit 100 having a 7-segment shape as to display numeric information, and a display unit 200 having an arrow shape as to display information on a state of process. The structures of the display unit 100 and the display unit 200 may be identical, and thus the display unit 100 will only be described hereinafter.

Figure 4:
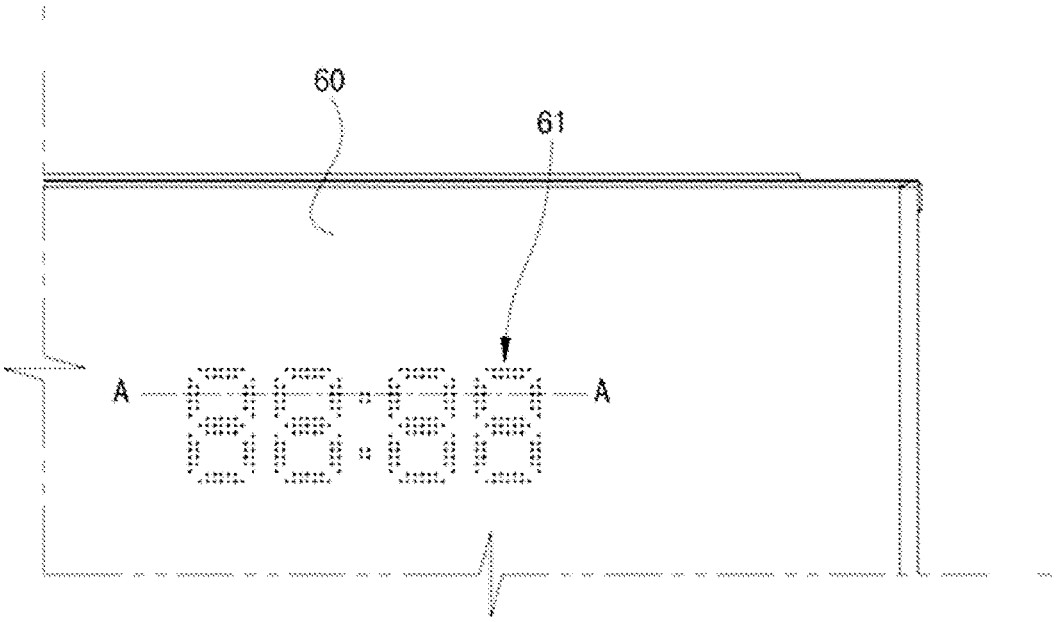
FIG. 4 is a drawing illustrating expended view of penetrating holes of the home appliance of FIG. 1.
Figure 5:
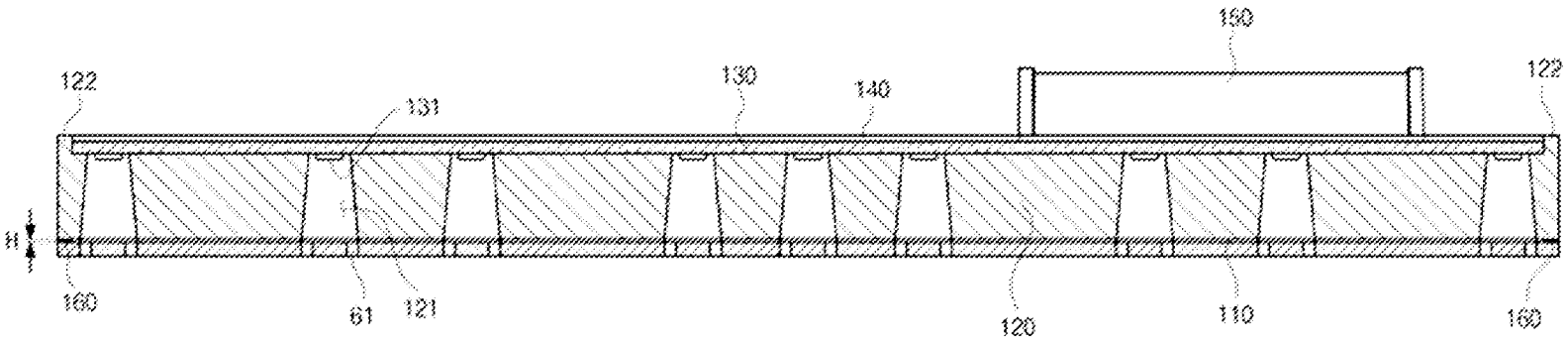
FIG. 5 is a cross-sectional view taken along line A-A of FIG. 4.
Figure 6:
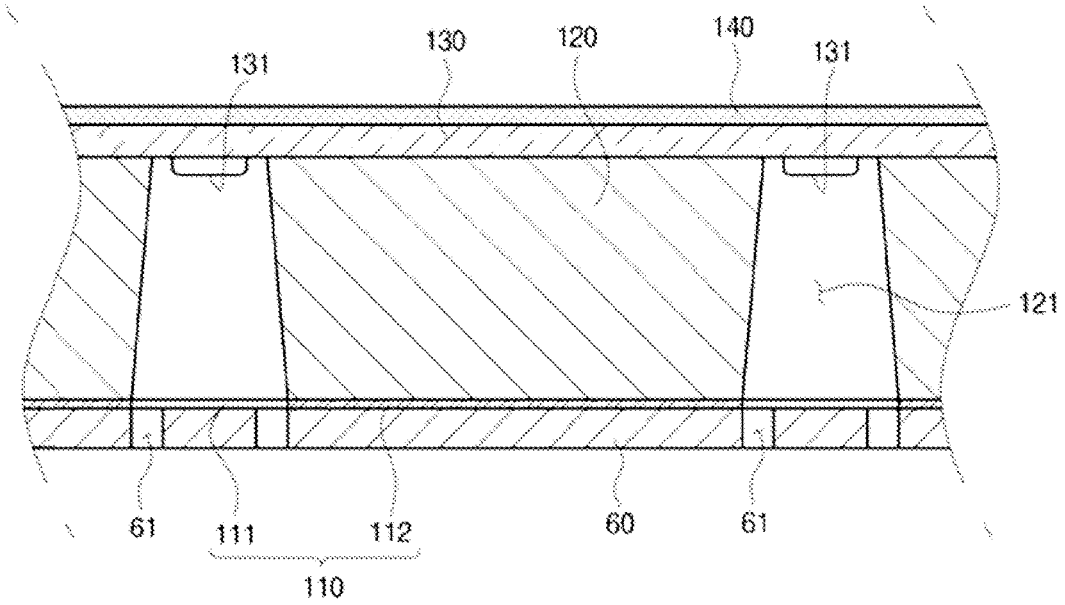
FIG. 6 is an enlarged view illustrating a portion of FIG. 5.
Figure 7:
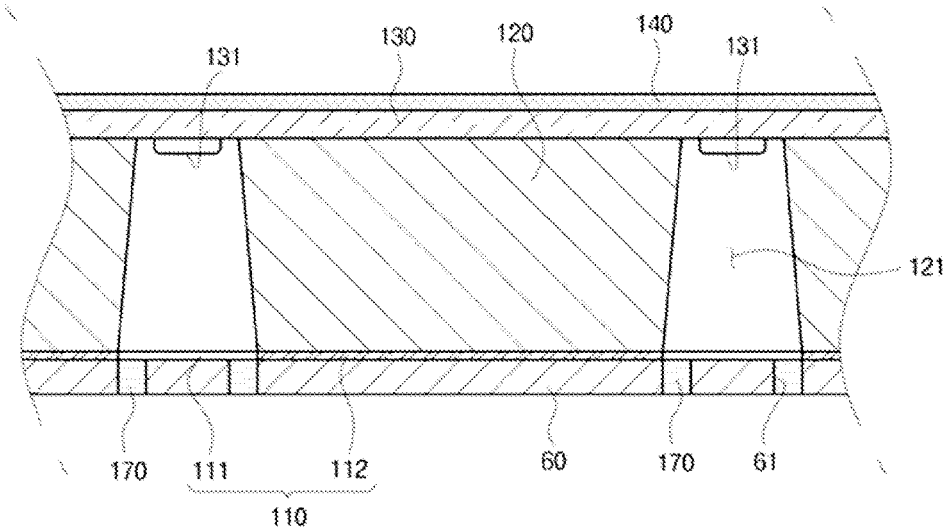
FIG. 7 is a drawing illustrating a state of the penetrating holes of the home appliance of FIG. 1 filled with filler member.
Figure 8:
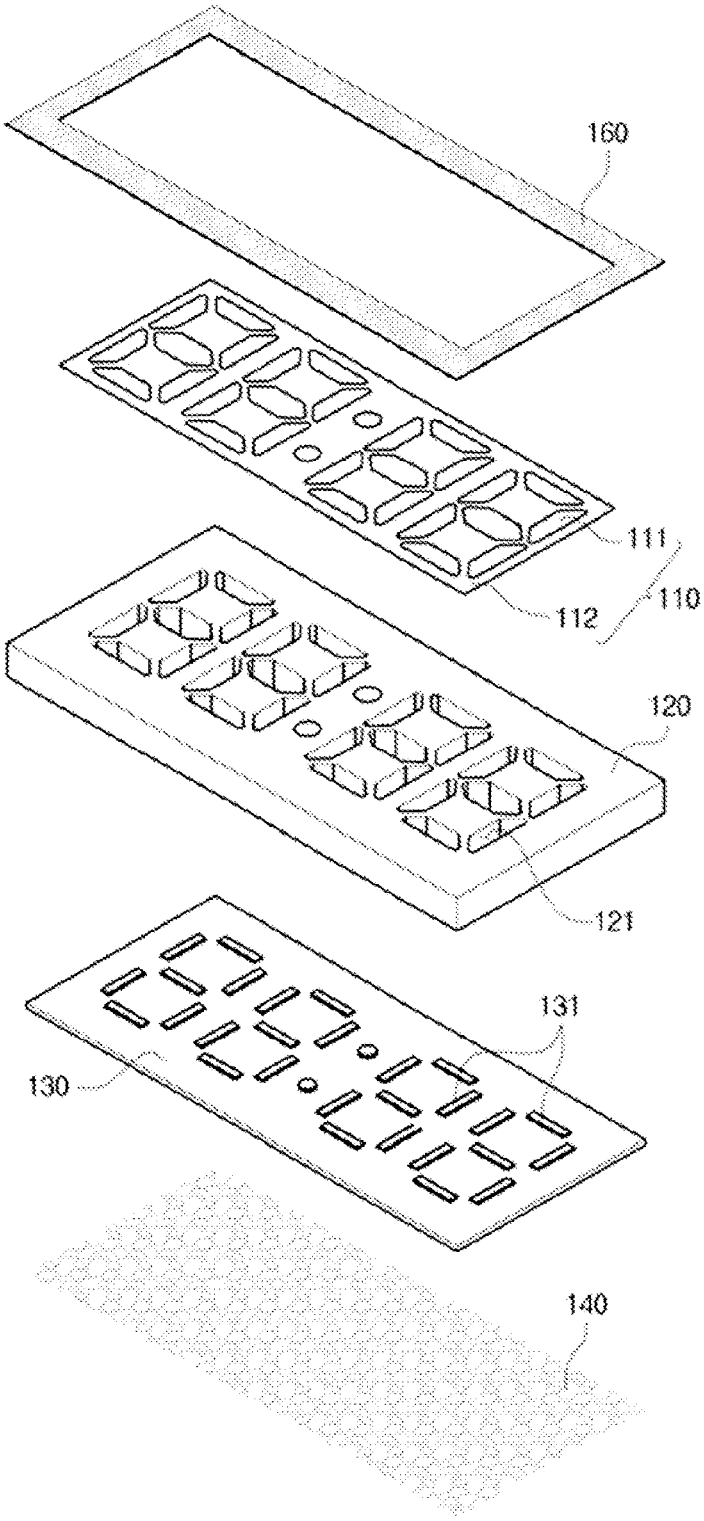
FIG. 8 is an enlarged view illustrating a display unit of the home appliance of FIG. 1.
Figure 9:
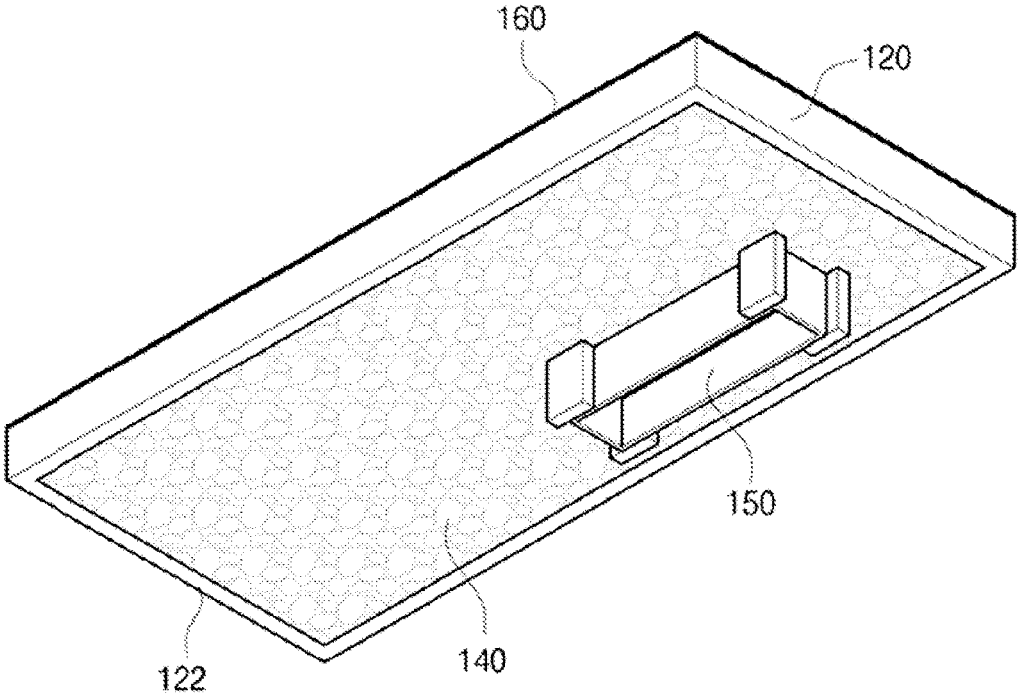
FIG. 9 is a perspective view illustrating a bottom surface of the display unit of the home appliance of FIG. 1.

FIG. 4 is a drawing illustrating expended view of penetrating holes of the home appliance of FIG. 1, FIG. 5 is a cross-sectional view taken along line A-A of FIG. 4, FIG. 6 is an enlarged view illustrating a portion of FIG. 5, FIG. 7 is a drawing illustrating a state of the penetrating holes of the home appliance of FIG. 1 filled with filler member, FIG. 8 is an enlarged view illustrating a display unit of the home appliance of FIG. 1, and FIG. 9 is a perspective view illustrating a bottom surface of the display unit of the home appliance of FIG. 1.

Referring to FIG. 4, FIG. 5, FIG. 6, FIG. 7, FIG. 8 and FIG. 9, the display unit 100 may include a printed circuit board 130 provided with at least one light emitting element 131, a guide member 120 to guide the light radiated from the at least one light emitting element 131, a display film 110 attached to a front surface of the guide member 120, and a cover member 140 provided at a rear of the guide member 120 as to prevent moisture from penetrating at the printed circuit board 130.

The light emitting element 131 may include a LED. The at least one light emitting element 131 may be individually controlled.

The guide member 120 may be integrally formed with resin material. The guide member 120 may include a guide path 121 to guide the light radiated from the light emitting element 131 toward a side of the display film 110, and supporting walls 122 protruded toward a rear side as to support the printed circuit board 130 and the cover member 140.

The supporting walls 122 may be formed at four borders as to support the printed circuit board 130 and the cover member 140.

The guide path 121 may be inclinedly formed such that the radius thereof is increased toward the display film 110. At least one light emitting element 131 may be disposed at the each guide path 121.

The printed circuit board 130 and the cover member 140 may be disposed in between the guide member 120 and the supporting walls 122.

The display film 110 may include a penetration portion 111 formed of transparent material or semi-transparent material as to penetrate light, and a non-penetration portion 112 formed of non-transparent material as not to penetrate light.

The penetration portion 111 may be provided with a predetermined design formed thereto as to display information of the dishwashing machine 1. As one example, the penetration portion 111 may be provided with 7 segments as to display numeric information.

The penetration portion 111 as such is disposed at a position corresponding to the penetrating holes 61 of the front surface panel 60 of the door 50, and may be provided as to occupy an area that is larger than the shape that the penetrating holes 61 form.

By use of the structure as such, the light radiated form the light emitting element 131 as the light emitting element 131 is turned on and off is penetrated through the guide path 121 of the guide member 120, and after passing through the penetrating holes 61 of the front surface panel 60, the light may be exposed to an outside the door 50, and a user may be able to recognize the display information.

As the above, the display film 110 is attached to the front surface of the guide member 120, the penetration of moisture and foreign substance to the printed circuit board 130 through a front entrance of the guide path 121 is prevented, and the penetration of moisture and foreign substance to the penetrating holes 61 of the front surface panel 60 may be prevented.

The display film 110 as such may be integrally formed at the guide member 120.

The penetrating holes 61 of the front surface panel 60 may be formed through an etching processing or a laser drilling processing. The penetrating holes 61 of the front surface panel 60 each may be provided with a diameter of from about 0.3 mm to about 0.5 mm. In addition, the penetrating holes 61 of the front surface panel 60 each may be arranged with a gap of between 0.5 mm and about 1.5 mm with respect to each other.

The penetrating holes 61 as such each may be provided with a predetermined shape as to correspond with respect to the shape of the penetration portion 111 of the display film 110.

The cover member 140 is configured to perform roles to prevent penetration of moisture and foreign substance through a rear side of the display unit 100 to the printed circuit board 130 and to fix the printed circuit board 130 to the guide member 120.

The cover member 140 may be of epoxy resin. The cover member 140 may be formed after disposing the printed circuit board 130 in between the supporting walls 122 of the guide member 120 and then molding epoxy resin at a rear of the printed circuit board 130.

The display unit 100 may further include a connector 150 connected to the printed circuit board 130 as to supply a power to the printed circuit board 130. The connector 150 as such may be exposed to an outside the display unit 100 after penetrating through the cover member 140. Epoxy resin may be molded after connecting the connector 150 to the printed circuit board 130.

As the above, as the cover member 140 is provided at a rear of the display unit 100, the penetration of moisture and foreign substance to the printed circuit board 130 is prevented, and thus the reliability of the display unit 100 may be improved.

The display unit 100 as such may be attached to a lower surface of the front surface panel 60 by use of an adhesive member 160. The adhesive member 160 may be provided at an edge of a front surface of the guide member 120. That is, the adhesive member 160 may be provided at an outer periphery of the display film 110 attached at a front surface of the guide member 120.

The adhesive member 160 and the display unit 100 are preferred to be formed at identical heights 'H' (FIG. 5) as to closely attach the display unit 100 and the front surface panel 60. By closely attaching the display unit 100 and the front surface panel 60, the adhesive member 160 may be able to prevent the penetration of moisture to the penetrating holes 61 of the front surface panel 60 and the printed circuit board 130 of the display unit 100.

The adhesive member 160 may be of a double-sided tape.

As the above, as the display unit 100 is attached to the front surface panel 60 by use of the adhesive member 160, the assembly of the display unit 100 may be easily performed, and the number of parts and material costs may be reduced.

However, differently from the present embodiment, in place of the adhesive member 160, by use of a separate supporting structure, the display unit 100 may be coupled to a lower surface of the front surface panel 60.

As illustrated on FIG. 7, a predetermined filler member 170 may be filled into the penetrating holes 61 of the front surface panel 60 as to prevent the difficulty of light penetrating through the penetrating holes 61, in a case the penetrating holes 61 may be blocked as a result of penetration of foreign substance.

The filler member 170 as such may be formed of transparent material or semi-transparent material. The filler member 170 may be of silicon resin or UV resin. The filler member 170 may be filled into the penetrating holes 61 by use of a method of applying silicon or UV paint at the front surface panel 60.

As is apparent from the above, a front surface panel of a door of a home appliance is formed of single material of steel plate, a display unit is hidden at an inside of the door, and the light radiated from the display unit may be displayed at an outside through penetrating holes formed at the front surface panel. According to an embodiment, a method of controlling light from a display unit inside a door is provided to display information on a front surface panel of the door. Thus, an exterior appearance design can be improved.

In addition, the display unit includes a cover member configured to prevent moisture from penetrating into a printed circuit board, such that a malfunction of a display due to the penetration of the moisture of a tub at the printed circuit board can be prevented.

In addition, the display unit is attached to a rear surface of the front surface panel through an adhesive member, and thus an assembly structure can be simplified, while the number of parts and costs can be reduced.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A home appliance, comprising:

a body;

a tub provided inside the body and having a front surface thereof open;

a door rotatably provided so as to open and close the tub, having a front surface panel, and a rear surface panel, the front surface panel being provided with penetrating holes so as to have light penetrated therethrough; and a display unit provided inside the door to display operation information through the penetrating holes of the front surface panel, wherein the display unit comprises:

a printed circuit board provided with at least one light emitting element;

a guide member to guide light radiated from the at least one light emitting element;

a display film having penetration portions corresponding with the penetrating holes of the front surface panel, and attached to the guide member; and a cover member provided at the guide member so as to prevent moisture from penetrating into the printed circuit board.

2. The home appliance of claim 1, wherein:

the front surface panel and the rear surface panel are formed of steel plate material.

3. The home appliance of claim 1, wherein:

the cover member comprises epoxy resin.

4. The home appliance of claim 1, further comprising:

an adhesive member to couple the display unit to a rear surface of the front surface panel.

5. The home appliance of claim 4, wherein:

the adhesive member is provided at an outer periphery of the display film.

6. The home appliance of claim 5, wherein:

the adhesive member and the display film are provided to have identical heights.

7. The home appliance of claim 1, wherein:

the guide member comprises supporting walls protruded so as to support the printed circuit board and the cover member.

8. The home appliance of claim 1, wherein:

the display unit further comprises a connector provided so as to penetrate the cover member such that a power is supplied to the printed circuit board.

9. The home appliance of claim 1, wherein:

a diameter of the penetrating holes is from about 0.3 mm to about 0.5 mm.

10. The home appliance of claim 1, wherein:

a gap between the penetration holes is between about 0.5 mm and about 1.5 mm.

11. The home appliance of claim 1, wherein:

the display unit further comprises a filler member filled in the penetrating holes so as to prevent foreign substance from penetrating into the penetrating holes.

12. The home appliance of claim 11, wherein:

the filler member is formed of transparent material or semi-transparent material.

* * * * *